US007225650B2

(12) United States Patent
Squier

(10) Patent No.: US 7,225,650 B2
(45) **Date of Patent: *Jun. 5, 2007**

(54) LOCK ASSEMBLY HAVING SECURING ENGAGEMENT PLATE

(76) Inventor: Randy Squier, 1333 Highland Rd., Stillwater, MN (US) 55082

( * ) Notice: Subject to any disclaimer, the term of this patent is extended or adjusted under 35 U.S.C. 154(b) by 0 days.

This patent is subject to a terminal disclaimer.

(21) Appl. No.: 11/284,512

(22) Filed: Nov. 22, 2005

(65) Prior Publication Data

US 2006/0070415 A1 Apr. 6, 2006

Related U.S. Application Data

(63) Continuation of application No. 10/827,490, filed on Apr. 19, 2004, which is a continuation of application No. 10/256,541, filed on Sep. 26, 2002, now Pat. No. 6,722,170.

(60) Provisional application No. 60/325,431, filed on Sep. 26, 2001.

(51) Int. Cl.
*E05B 49/00* (2006.01)

(52) U.S. Cl. ..... 70/278.1; 70/446; 70/443; 292/DIG. 53; 292/DIG. 64

(58) Field of Classification Search ..... 70/278.1, 70/466, 279.1, 370, 443–451, 461, 417; 292/DIG. 53, 54, DIG. 64; 403/256–259, 403/335–337, 408.1, 373, 230
See application file for complete search history.

(56) References Cited

U.S. PATENT DOCUMENTS 1,046,127 A 12/1912 Weatherwax
3,236,342 A 2/1966 Persson
3,623,757 A 11/1971 Schlage
3,674,246 A 7/1972 Freeman
4,052,094 A 10/1977 Widen
4,074,552 A 2/1978 Smith
4,456,290 A 6/1984 Gross et al.
4,688,409 A 8/1987 Oliver et al.
4,708,007 A 11/1987 Stoia
4,782,677 A 11/1988 O'Gara
4,887,856 A 12/1989 Percoco et al.

(Continued)

OTHER PUBLICATIONS

Sargent & Greenleaf Premium Security Locks Catalog: Jun. 13, 2001.

*Primary Examiner*—Suzanne Dino Barrett
(74) *Attorney, Agent, or Firm*—Robert C. Freed; Moore & Hansen

(57) ABSTRACT

A lock assembly for attachment to an enclosure door. The enclosure door has a lock assembly receiving opening specifically created to receive the lock assembly. The preferred lock assembly includes a lock case assembly having a bolt that can be moved between at least two positions; a lock actuating assembly interconnected with the lock case assembly such that the lock actuating assembly can actuate a change in the position of the bolt from one position to another; and a mounting plate having an interior side and an exterior side. The lock actuating assembly is preferably secured to the mounting plate on the exterior side and the lock case assembly is preferably secured to the mounting plate on the interior side. In alternate embodiments, the present invention provides a mounting plate, an enclosure door including a lock assembly and a method of securing a lock assembly to an enclosure door. A method of securing a preassembled electronic lock assembly to an enclosure door is provided.

17 Claims, 4 Drawing Sheets

U.S. PATENT DOCUMENTS 4,936,122 A 6/1990 Osada
4,967,305 A 10/1990 Murrer et al.
5,020,345 A 6/1991 Gartner et al.
5,033,282 A 7/1991 Gartner et al.
5,113,675 A 5/1992 Uyeda
5,267,461 A 12/1993 Eizen
5,451,934 A 9/1995 Dawson et al.
5,473,922 A 12/1995 Bair et al.
5,488,358 A 1/1996 Hamilton et al.
5,488,660 A 1/1996 Dawson et al.
5,493,279 A 2/1996 Dawson et al.
5,709,114 A 1/1998 Dawson et al.
5,787,741 A 8/1998 Shen
5,841,347 A 11/1998 Kim
5,841,361 A 11/1998 Hoffman
5,893,283 A 4/1999 Evans et al.
5,941,654 A 8/1999 Chauquet
6,098,433 A 8/2000 Maniaci
6,298,699 B1 10/2001 Gartner et al.
6,469,247 B1 10/2002 Dodds et al.

LOCK ASSEMBLY HAVING SECURING ENGAGEMENT PLATE

CROSS REFERENCE TO RELATED APPLICATIONS

The present application claims priority to and is a Continuation of pending U.S. patent application Ser. No. 10/827,490 entitled LOCK ASSEMBLY HAVING SECURE ENGAGEMENT PLATE, filed Apr. 19, 2004, which claims priority to and is a Continuation of U.S. patent application Ser. No. 10/256,541 entitled LOCK ASSEMBLY HAVING SECURE ENGAGEMENT PLATE, filed Sep. 26, 2002, now issued as U.S. Pat. No. 6,722,170, which claims priority to U.S. Provisional Application Ser. No. 60/325,431 for LOCK ASSEMBLY HAVING SECURE ENGAGEMENT PLATE, filed Sep. 26, 2001.

FIELD OF THE INVENTION

The present invention provides a lock assembly, including a mounting plate for securing the lock assembly to an enclosure door, preferably a computer enclosure door. In preferred embodiments, the lock assembly includes components of an electronic lock, preferably including a Dallas™ chip, which enables the lock to monitor entry into the computer enclosure. The present invention also includes an enclosure door including such a lock assembly.

BACKGROUND OF THE INVENTION

Locks to limit access to enclosures are well known in the art as are locks which monitor access to enclosures. Such locks are manufactured by a number of companies, most prominently Sargent & Greenleaf Lock Manufacturer's, Inc., Nicholasville, Ky.; LaGard, Inc., Torrance, Calif. and Kaba Mas, Inc. of Lexington, Ky. These locks can limit access to the inside of an enclosure to individuals who have a specific entry code which they are required to enter when seeking access to the enclosure. The locks can also monitor and keep a record of which codes are used to obtain access to the enclosure and when such access is obtained. These types of locks are well known in the art.

Unfortunately, from time to time the lock may need to be serviced or the owner of an enclosure may wish to upgrade from one lock to another. The installation of such a lock is time consuming and often requires an owner to request service from an outside service provider. In addition, original equipment manufacturers (OEM's) are also generally looking to simplify installation so that costs for labor can be reduced, thereby reducing the overall cost to the consumer of using the OEM's lock.

In the Detailed Description of this application, a description is provided of an AUDITCON™ lock made by Kaba Mas, Inc., Lexington, Ky. The present invention includes such a lock or such other lock that would provide similar security features.

In the past, Mas-Hamilton and other lock manufacturers have provided their locks to manufacturers of enclosures, preferably enclosures used to enclose banking equipment, computer servers and other sensitive electronic equipment, to which owners of such equipment wish to limit access and document all such access. The Mas-Hamilton locks of this type limit access by providing an electronic lock or latch mechanism and document access that is granted. It will be appreciated that installation requires a fair amount of skilled labor and care. In addition to the difficulty associated with securing the locks, a further concern is the security provided by the locks when they are attached to an enclosure door. It may be possible to strike such a lock from the outside of the enclosure, that the outer portion and the inner portion of the lock assembly are disengaged from the enclosure door, allowing the enclosure to fall open.

It will be appreciated from the foregoing, therefore, that prior art devices and methods of installing these devices present problems which are in need of solutions. It also will be appreciated that further enhancements of the security provided by such locks are needed. The present invention provides solutions for these and other problems.

SUMMARY OF THE INVENTION

The present invention is directed in one embodiment to a lock assembly including a dial assembly or lock actuating assembly and a lock bolt or lock case assembly, which sandwich an engagement plate or a mounting plate to which each is secured to form the lock assembly. The mounting plate preferably includes a number of different functional parts which allow the respective assemblies to be secured to the mounting plate and also allow the mounting plate to permit the lock assembly to be secured within an opening within a door of an enclosure.

In one preferred embodiment, the mounting plate includes a plurality of drilled and tapped holes, a plurality of Standoffs and a plurality of securing studs. In the further preferred embodiment, a lock assembly for attachment to an enclosure door is provided, comprising: a lock case assembly including a bolt having at least first and second positions; a lock actuating assembly interconnected with the lock case assembly such that the lock actuating assembly can actuate a change in the position of the bolt from the first position to the second position; and a mounting plate having an interior side and an exterior side; the lock actuating assembly being secured to the mounting plate on the exterior side and the lock case assembly being secured to the mounting plate on the interior side. The lock case assembly is preferably secured within a lock assembly receiving opening by at least one interior mounting plate securing bracket secured to the interior side of the mounting plate and effectively gripping an edge of a lock receiving opening in the enclosure door.

In further preferred embodiments, the present invention provides an enclosure door having a lock assembly, including a mounting plate such as the mounting plate disclosed hereinabove, secured within a lock assembly receiving opening in the enclosure door.

In a further preferred embodiment, the present invention provides a method for securing a lock assembly to an enclosure door, the method including creating an opening in the enclosure door, inserting the lock assembly in the opening and securing the lock assembly to the enclosure door.

The lock assembly preferably includes a lock case assembly having a bolt that can be moved between at least two positions; a lock actuating assembly interconnected with the lock case assembly such that the lock actuating assembly can actuate a change in the position of the bolt from one position to the other; and a mounting plate having an interior side and an exterior side. The lock actuating assembly is secured to the mounting plate on the exterior side and the lock case assembly is secured to the mounting plate on the interior side. The lock assembly itself is secured within the lock assembly receiving opening of the enclosure door by an interior mounting plate securing bracket, preferably two such brackets, which are secured to the interior side of the mounting plate and effectively grip an edge or preferably edges of the enclosure door proximate the lock receiving opening so that the lock assembly is secured to the enclosure door.

It will be appreciated that the present lock assembly reduces the complexity of installation of locks of this type and reduces the expense associated with such installation and also reduces the amount of time and energy associated with such installation.

It is an object of the present invention, therefore, to provide a lock assembly which can be installed in a standard enclosure door in a straightforward and expeditious manner without disassembly of the lock assembly prior to installation. In the most preferred embodiment, the lock assembly is installed by placing the lock assembly within a lock assembly receiving opening created in the enclosure door and securing the lock assembly to the enclosure door by placing at least one, preferably two, interior mounting plate securing brackets over respective pairs of securing studs, securing the interior mounting plate securing brackets to the respective securing studs with stud securing nuts which are tightened such that the interior mounting plate securing brackets grip edges of the lock assembly receiving opening of the enclosure door.

It is a further object of the present invention to provide a simplified electronic lock assembly which is easy to install, easy to remove for repair or enhancement and easy to reinstall or replace.

It is a further object of the present invention to provide a system for enhanced security for enclosure doors by providing a mounting plate which secures the lock case assembly to the enclosure door even if the lock actuating assembly is destroyed or disengaged from the mounting plate.

It is a further object of the present invention to provide a mounting plate which is specifically designed to secure the lock case assembly to the interior side of the mounting plate while the enclosure door is secured to the mounting plate on the interior side as well, thereby enhancing the security provided by the mounting plate, as well as the present lock assembly.

It is a further object of the present invention to provide a kit including the mounting plate and other accessories, preferably an interior mounting plate securing brackets and a plurality of stud securing nuts for securing the mounting plate to an enclosure door having a lock assembly receiving opening suitable for mounting the present mounting plate.

The above-described features and advantages along with various other advantages and features of novelty are pointed out with particularity in the claims annexed hereto and forming a part hereof. However, for a better understanding of the invention, its advantages and objects attained by its use, reference should be made to the drawings which form a further part hereof and to the accompanying descriptive matter, preferred embodiments of the present invention.

BRIEF DESCRIPTION OF THE DRAWINGS

Referring now to the drawings, in which like reference numerals refer to equivalent elements in a series of embodiments of the present invention.

DETAILED DESCRIPTION OF THE PREFERRED EMBODIMENT

Figure 1:
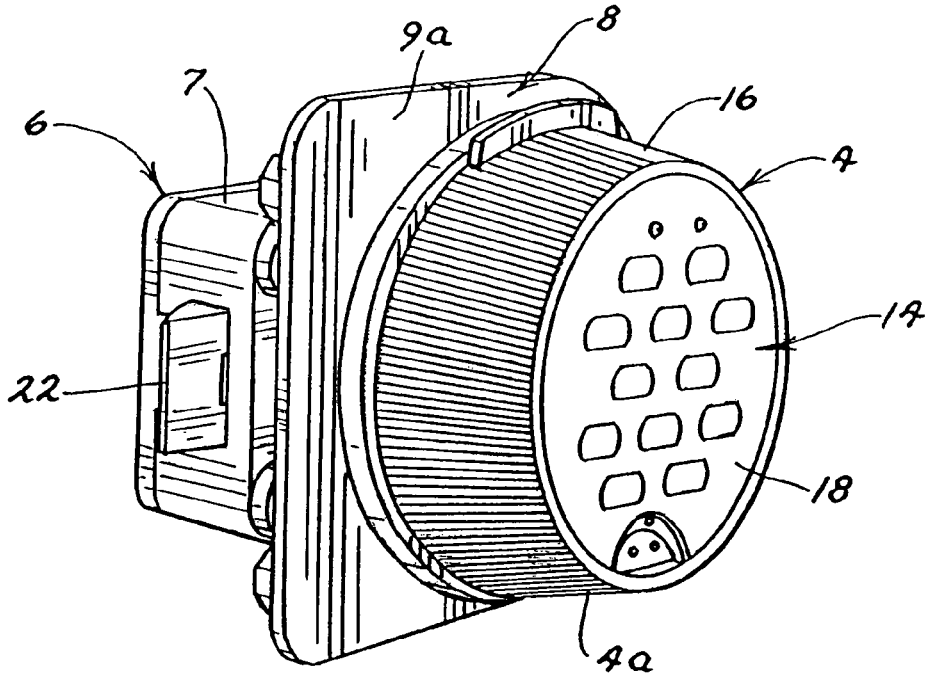
FIG. 1 is a perspective view of a preferred lock assembly 2 of the present invention showing an exterior side 9*a* of a mounting plate 8 sandwiched between a lock actuating assembly 4 and a lock case assembly 6.
Figure 2:
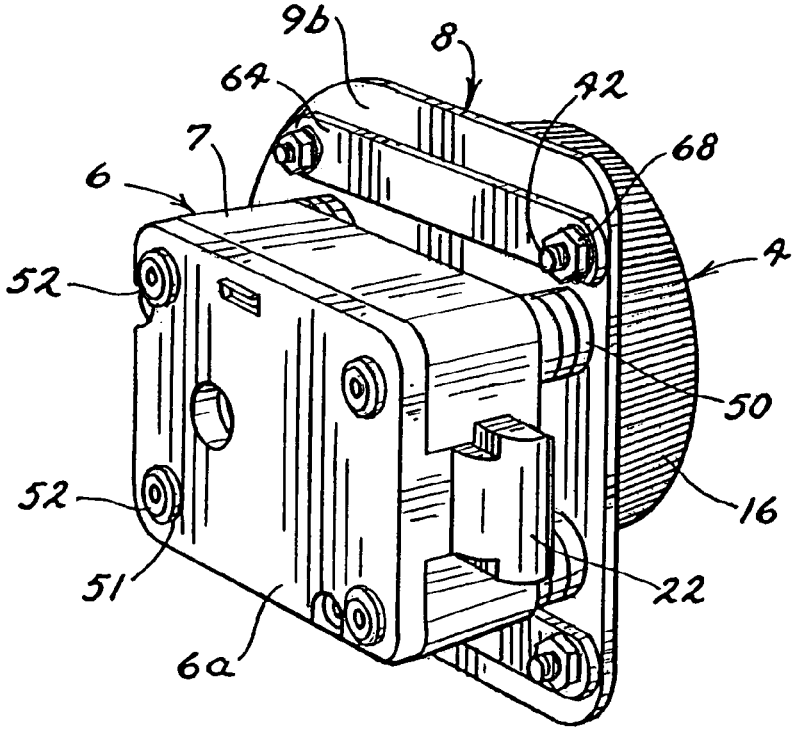
FIG. 2 is a further perspective view of the lock assembly 2 shown in FIG. 1, but showing an interior side 9*b* of the mounting plate 8.

Referring now to FIGS. 1 and 2, the present invention provides a lock assembly 2 including a dial assembly or lock actuating assembly 4, a lock case or bolt assembly 6 and a mounting plate 8. The mounting plate has an exterior side 9*a*, shown primarily in FIG. 1, and an interior side 9*b*, shown primarily in FIG. 2.

Figure 3:
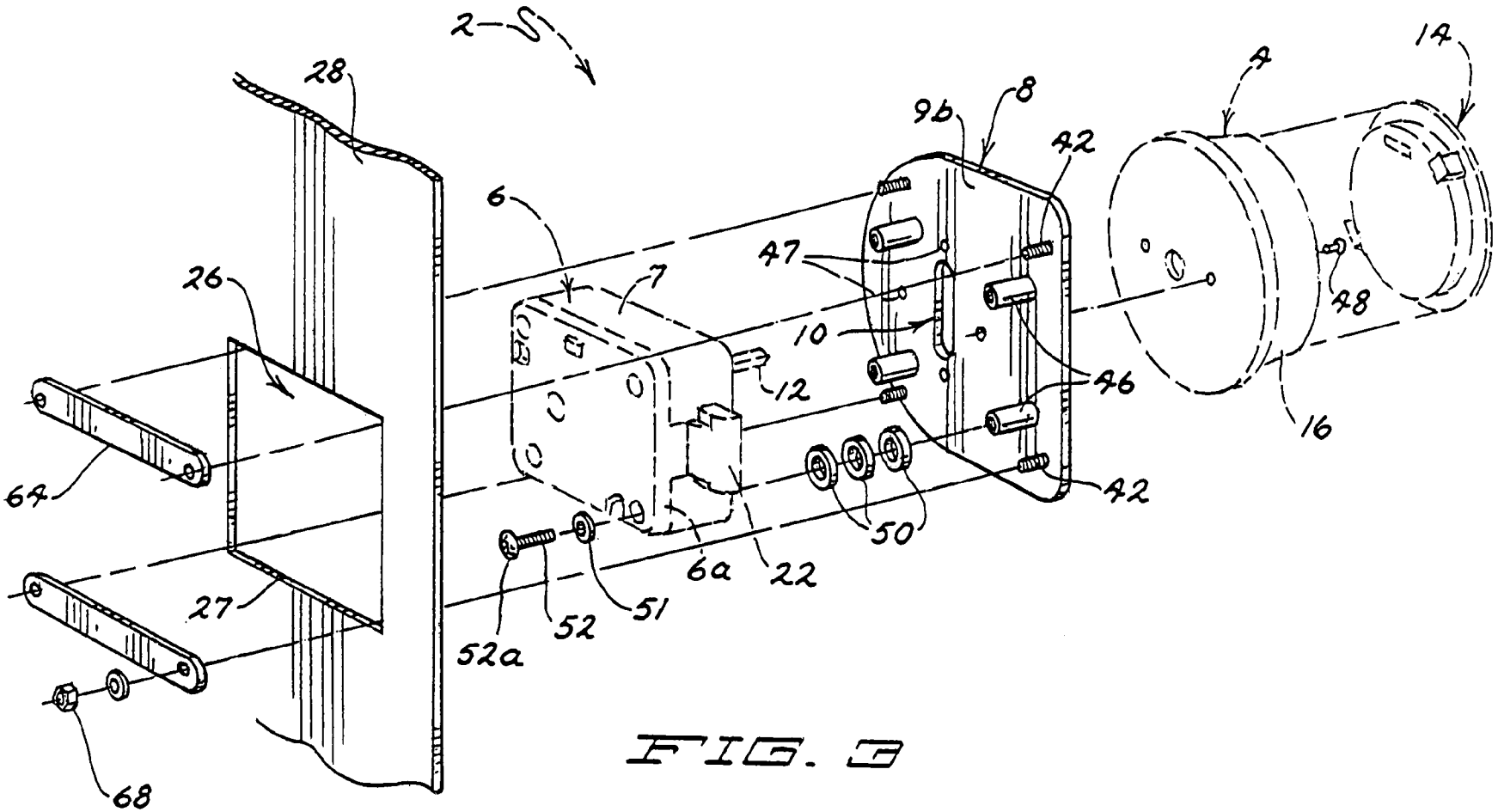
FIG. 3 is an exploded perspective view of the lock assembly 2 shown in FIGS. 1 and 2 as it would come apart when secured within a lock assembly receiving opening 26 within an enclosure door 28.
Figure 4:
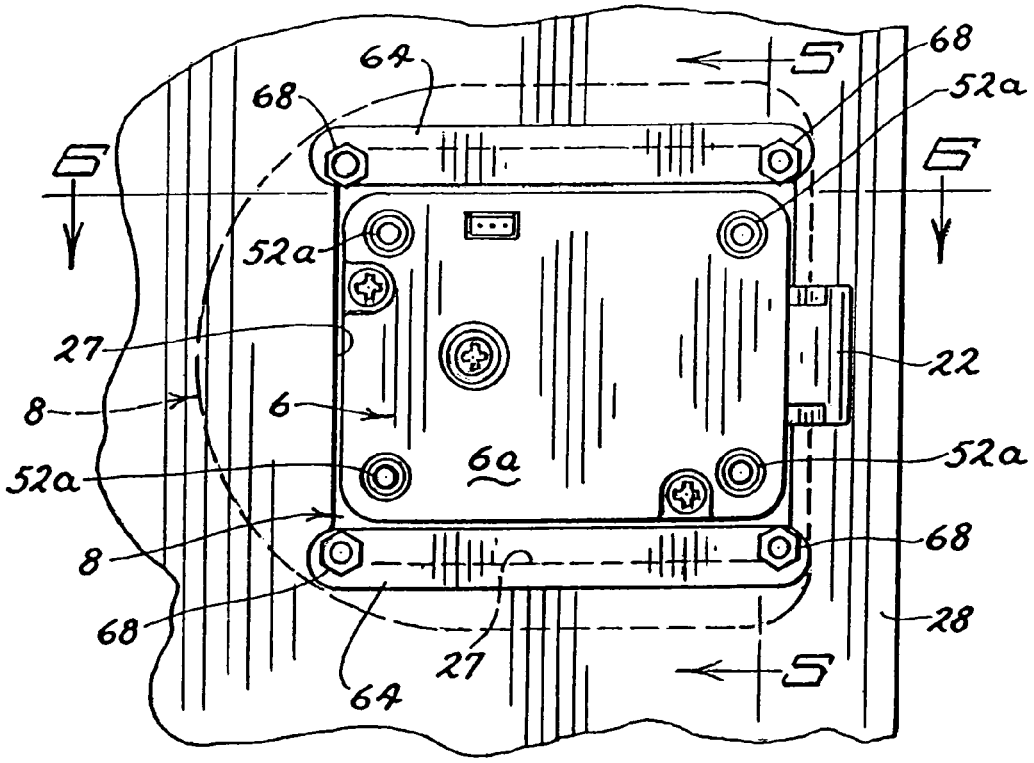
FIG. 4 is a side plan view of the lock assembly shown in FIGS. 1 and 2 from the inside 29 of the enclosure door 28 showing the outline of the mounting plate 8 and the outline of the lock assembly receiving opening 26 at least partially in phantom.
Figure 5:
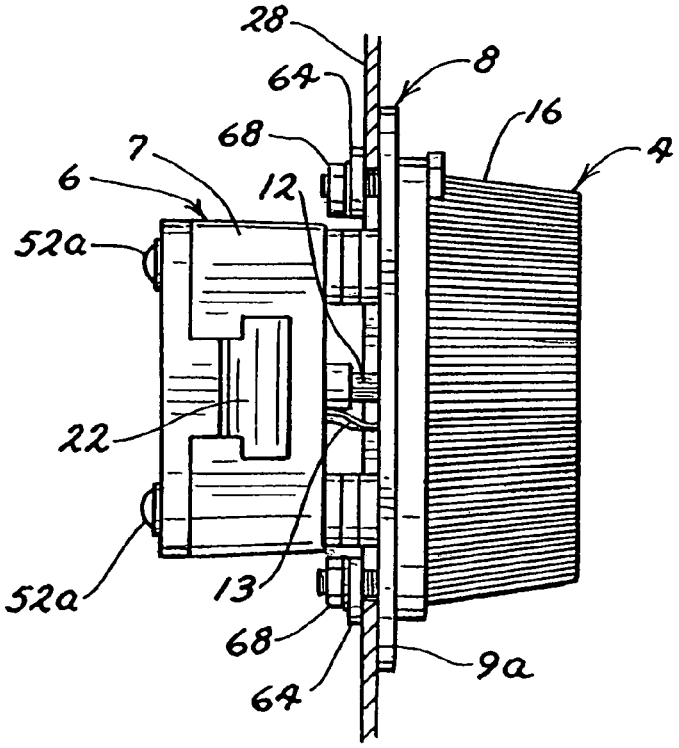
FIG. 5 is a side elevation of the lock assembly 2 when engaged with the enclosure door 28 as seen from line 5–5 of FIG. 4.

Referring now also to FIG. 3 which provides an exploded view of parts of the lock assembly 2 when secured to an enclosure door 28, as shown in FIGS. 4 and 5, to which reference is also made at this time.

The preferred lock assembly shown in FIGS. 1–5 includes a mounting plate 8 having a center hole 10 through which a spindle 12, extending from the lock case assembly 6 can extend to become engaged within the lock actuating assembly. The preferred lock actuating assembly 4 and lock case assembly 6 are respective parts of an AUDITCON™ lock available from Kaba Mas, Inc., Lexington, Ky., such as the series 50R, 52R, 100R, 200R, 400R, 500R and 2100R series AUDITCON™ locks.

Other locks may be substituted for the preferred lock. These locks include the V series, LP series, Vindication™ series, X08/X07 series, LC series and the like locks from Kaba Mas or Mas-Hamilton, the ComboGuard®, DelaGuard®, TimeDealy™, SafeGuard™, TwoBolt™, Privat®, SmartGuard™, DigiGuard®, LGAudit™, LGBaSiC™, LGCombo™, eCam®, MultiGuard™, VisionGuard™ and the like series from LeGard, and the Comptronic® 6120, 6121, 6123, 6124, 6125, 6140, 6150 and the like series from Sargent & Greenleaf, along with any other similar two, or more, component lock systems from these or other access lock or other lock manufacturers.

The preferred lock actuating assembly 4 includes a keypad 14, which allows the user to enter an access code which, once entered, will cause the lock actuating assembly to actuate movement of a bolt 22 in the lock case assembly 6 by turning the spindle 12. Mas-Hamilton also produces similar locks having a low profile housing (now shown) and a vertical lock housing (not shown). The Mas-Hamilton locks have two different modes of operation, an independent mode and a Supervisory/Subordinate mode. Within each operation mode, two access modes are available: Single User access and Dual User access. In Single User access, only one combination is required to open the lock. In Dual User access, two combinations must be correctly and consecutively entered to open the lock.

Independent mode—When operating in Independent mode, only one (Single User access) or two (Dual User access) combinations are required to open the lock. In Dual User access, either combination can be entered first. However, you should not turn the dial or press Clear between combination entries.

Supervisory/Subordinate mode (Super/Sub mode)—When operating in Super/Sub mode, a Supervisor must first enable lock access for Subordinate User(s) in order for them to be able to open the lock. In Single User access, two separate combinations are required to open the lock. A Supervisor combination followed by an assigned Supervisor ID must be entered first to enable lock access for a Subordinate User combination. The Subordinate User combination can be entered an unlimited number of times thereafter to open the lock. Once the Supervisor combination and the assigned Supervisor ID are re-entered to disable lock access for a Subordinate User, the Subordinate User combination will no longer open the lock.

In Dual User access, three separate combinations are required to open the lock. A Supervisor combination followed by an assigned Supervisor ID must be entered first to enable lock access for two Subordinate User combinations. The Subordinate User combinations can be entered an unlimited number of times thereafter (and in any order) to open the lock. Once the Supervisor combination and the assigned Supervisor ID are re-entered to disable lock access for the Subordinate User(s), these Subordinate User combinations will no longer open the lock.

There are four different types of classifications of personnel who can access the lock:

Master User—The Master User performs the initial lock setup activities. There is a maximum of one Master User per lock. The Master User combination will not open the lock.

Access User—In Independent mode, a user added by a Master User.

Supervisor—In Supervisory/Subordinate mode, a user added by the Master User and who has the ability to add/delete other Subordinate users. The maximum number of Supervisors per lock varies according to lock model. A Supervisor cannot open the lock.

Subordinate User—In Supervisor/Subordinate mode, a user who is added by and assigned to a Supervisor.

Figure 6:
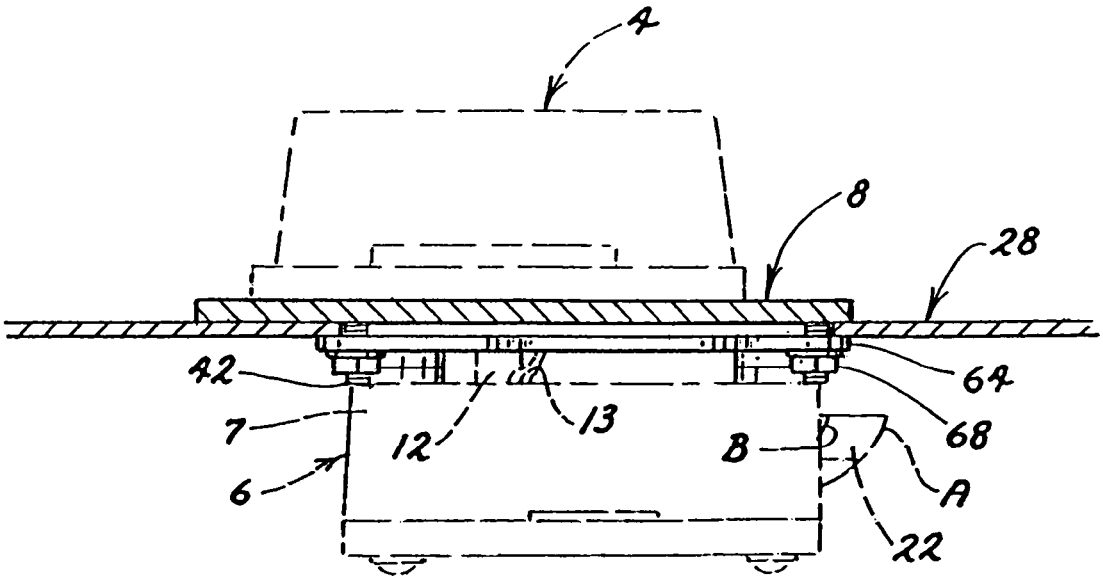
FIG. 6 is a partial cross-sectional view from the top of the lock assembly 2 shown in FIG. 4 as seen from the line 6–6 showing the enclosure door 28 and the mounting plate 8 in partial cross-section and wherein the lock actuating assembly 4 and the lock case or bolt case assembly 6 are shown in phantom.

Referring now also to FIG. 6, the preferred lock assembly 2 shown in FIG. 4 is shown as seen from line 6—6 of FIG. 4, showing the enclosure door 28 in partial cross-section and the lock actuating assembly 4 and the lock case assembly 6 in phantom. In FIG. 6, the tip 22*a* of the bolt 22 is shown in phantom once in a first position, A, where the tip is extended out away from the lock case assembly housing 7 and a second position, B, in which the tip 22*b* of the bolt 22 protrudes only slightly from the lock case assembly housing 7. It is envisioned that the bolt 22 will engage a structure (not shown) associated with the enclosure (not shown) when the enclosure door 28, preferably pivotally attached, is attached to the enclosure (not shown). In this way, the bolt 22 will provide a mechanism for engaging the enclosure structure (not shown) when it is in the first position in which the lock assembly 2 will engage the enclosure (not shown) to keep the enclosure door 28 in a secured and closed position (not shown).

Figure 7:
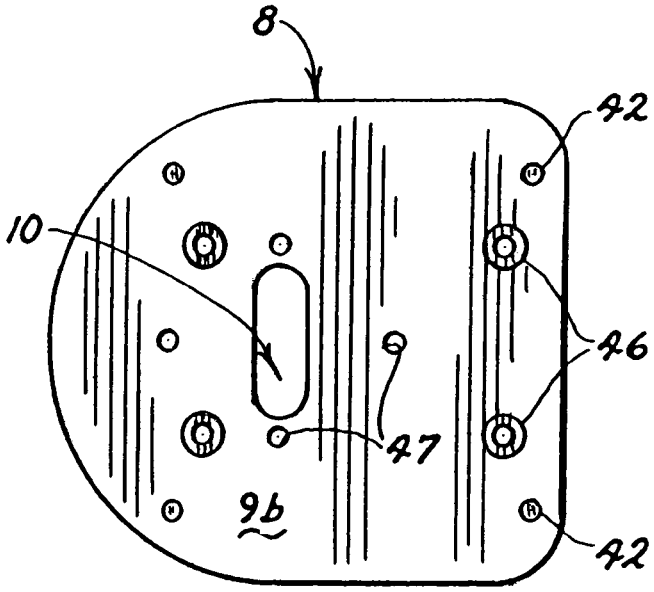
FIG. 7 is a to plan view of the mounting plate 8 showing the interior side 9*b*.
Figure 8:
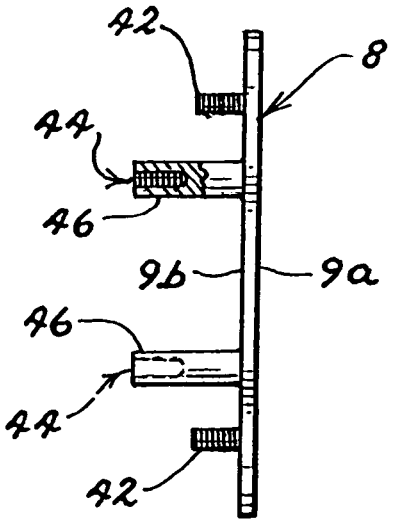
FIG. 8 is a right side elevation of the mounting plate 8, shown in FIG. 7, showing one of the two standoffs 46 in partial cross-section and the tapped hole in the other standoff 46 in phantom.

Referring now also to FIGS. 7 and 8, the mounting plate 8 of the present invention preferably has a shape similar to that shown in FIG. 7. In alternate embodiments, the shape of the mounting plate may vary, and the position of the various openings, holes or attachments to the mounting plate may be varied as well in order to accommodate a variety of lock actuating assemblies, lock case assemblies and the like. The main feature of the mounting plate 8, however, is that it will provide a plate having an exterior side 9*a* and an interior side 9*b*, the preferred mounting plate 8 includes four securing studs 42 attached to the interior surface 9*b*. In the present application, the term "securing stud" means a protrusion extending away from the interior surface 9*b* of the mounting plate 8, to which a securing bracket 64 may be secured. These securing studs 42 can be threaded studs, welded or weld studs, PEM® studs or the like. A securing bracket 64, such as the interior mounting plate securing bracket 64, see FIGS. 4–6, can be secured to the securing studs, but other well known fastening systems can also be used. In preferred embodiments, the securing studs are threaded such that they accept stud securing nuts which screw onto the securing studs 42 to secure a securing bracket 64 which can grip an edge 27 of the lock assembly receiving opening 26 in the enclosure door 28. In a preferred embodiment, the securing studs 42 are PEM® studs from Pem Fastening Systems, Danboro, Pa. that are pressed into drilled or drilled and tapped holes, stamped holes, or the like. Alternatively, the securing studs 42 are spot welded onto the interior surface of the mounting plate 8.

The mounting plate 8 also includes four T-nuts 46 or standoffs 46 having standoff receiving openings 44 in which standoff screws 52, for securing the lock case assembly 6, can be secured. In preferred embodiments, the lock assembly 2 includes a plurality of Standoff spacers 50 that are used to separate the lock case assembly 6 from the mounting plate 8 a sufficient distance to permit the standoff screw to bind the lock assembly standoff screws 52 to tightly secure the lock case assembly 6 to the mounting plate 8. A washer 51 is also used to space the head 52*a* of the screw 52 away from an upper surface 6*a* of the lock assembly so that the standoff screw 52 effectively secures the lock assembly 6 to the mounting plate by engaging the threaded standoff receiving openings 44 in the standoffs 46.

The mounting plate also includes the center hole 10, which allows the spindle 12 to pass through the mounting plate 8 from the lock case assembly 6 to the lock actuating assembly 4. A wire harness 13 also passes through the mounting plate to connect the lock actuating assembly 4 electronically with the lock case assembly 6 so that the act of entering a recognized code into the keypad 14 of the lock actuating assembly is effective to permit the spindle 12 to turn within the lock case assembly 6 and move the bolt 22 from the first position 22*a* to the second position 22*b* (shown in FIG. 6 in phantom). The preferred mounting plate 8 also includes four drilled and tapped holes 47 which accept lock actuating assembly securing screws 48 which secure the lock actuating assembly 4 to the exterior surface 9*a* of the mounting plate 8.

The preferred electronic assembly 2 is assembled by displacing the keypad 14 from the lock actuating assembly 4 in order to secure the remaining housing for A to the exterior surface 9*a* of the mounting plate 8. Lock actuating assembly securing screws 52 or standoff screws 52 are used to secure the lock actuating assembly housing 4*a* to drilled and tapped holes 47 in the mounting plate. The keypad 14 is then secured to the lock actuating assembly housing 4*a*. The lock case or bolt assembly 6 is also secured to the mounting plate 8 using screws 52. Four standoff screws 52 are used to secure the lock case assembly to the interior side of the mounting plate.

The lock assembly 2 also includes two interior mounting plate securing brackets 64 which can be secured to the interior side 9*b* of the mounting plate 8 by a plurality of stud securing nuts 68 which can secure the interior mounting plate securing brackets 64 to the weld stud 42 in the manner shown in FIG. 2.

To secure the lock assembly 2 to the enclosure door 28, however, the interior mounting plate securing brackets 64 are preferably disengaged from the securing studs 42 and engaged with the enclosure door 28 within the lock assembly receiving opening 26. To secure the lock assembly 2, within the lock assembly receiving opening 26, the interior mounting plate securing brackets 64 are placed over the securing studs 42 when the lock assembly 2 is in place in the enclosure door 28 within the lock assembly receiving opening 26, thereby sandwiching edges 27 of the lock assembly receiving opening 26 between the mounting plate 8 and respective interior mounting plate securing brackets 64. Stud securing nuts 68 are used to secure the interior mount plate securing brackets against the edges 27 of the locking assembly receiving opening so as to grip the enclosure door 28 between the interior mounting plate securing brackets 64, respectively, and the mounting plate 8.

In a preferred embodiment, the present invention provides a kit including a mounting plate 8 of the present invention and two interior mounting plate securing brackets 64. In preferred embodiments, the kit also includes stud securing nuts 68, spacers 50 and standoff screws 52.

In a further, preferred embodiment of the present invention, a method of securing the lock assembly 2 to an enclosure door 28 is provided, including the steps of creating a lock assembly receiving opening 26 in the enclosure door 28; placing the lock assembly 2 within the lock assembly receiving opening 26 in the enclosure door 28; and securing the lock assembly 2 within the lock assembly receiving opening by securing at least one interior mounting plate securing bracket to the interior side 9*b* of the mounting plate 8 and sandwiching at least a portion of the enclosure door 28 between the interior mounting plate securing bracket and the mounting plate 8 in such a manner that the lock assembly 2 is functionally secured to the enclosure door 28.

The present lock assembly 2 has been designed to simplify the installation of a lock, preferably an AUDITCON™ lock available from Kaba Mas, Inc. Installation using the lock assembly 2, requires the creation of a hole 26 in a door 28 to an enclosure (not shown), preferably a rectangular or square hole in certain embodiments, although the hole may vary in its configuration and size.

It is an object of the present invention to provide an assembly 2 which preferably includes components of a lock such as the AUDITCON™ lock for incorporation into an enclosure door 28 to limit access to an interior (not shown) of an enclosure (not shown). It is a further object of the present invention to provide a quickly attached assembly 2 for such use.

In order to install the preferred lock assembly 2 of the present invention in a computer enclosure (not shown), the enclosure door opening 26 is preferably provided in the enclosure door 28. In preferred embodiments, the enclosure door opening 26 is a rectangular or, perhaps, square opening.

The lock assembly 2 is secured to the enclosure door 28, within the enclosure door opening 26 by placing the lock assembly 2 within the enclosure door opening 26 and securing interior mounting plate securing brackets 64 to the respective securing studs 42 using alternate stud securing nuts 68, such as Nyloc nuts or the like. The preferred stud securing nuts 68 hold the interior mounting plate securing brackets 64 against the enclosure door 28 at edges 27 of the enclosure door opening 26 to secure the lock assembly 2 to the enclosure door 28. In the side view of the lock assembly 2, shown in FIGS. 4–6, the lock assembly 2 is shown secured to the enclosure door 28.

The simplicity with which the preferred lock assembly 2 can be installed within a computer enclosure door 28 is discussed. In preparation for installation, an opening 26 is cut or otherwise created in the enclosure door 28. The lock assembly 2 is then inserted into the enclosure door opening 26 from the outside of an enclosure door 28 so that the lock case assembly 6 is inserted into the lock assembly receiving opening 26 and each of the securing studs 42 are placed within the enclosure door opening 26 so that the mounting plate 8 abuts against the outside 30 of the enclosure door 28. As shown in FIG. 3, the interior mounting plate securing brackets 64 are then placed on the securing studs 42, thereby sandwiching the edges 27 of the lock assembly receiving opening 26 between the interior mounting plate securing brackets 64, respectively, and the mounting plate 8. Once the interior mounting plate securing brackets 64 are placed on the respective securing studs 42, stud securing nuts 68 are screwed onto the securing studs 42 to secure the lock assembly 2 to the enclosure door 58 as shown in FIGS. 4–6. The stud securing nuts may be tightened using an appropriate tightening tool not shown.

Although the preferred electronic lock of the present invention is an AUDITCON™ lock in the R series, AUDITCON™ locks having a low profile housing (LP) or a vertical lock housing (V) are also encompassed by the present invention. Furthermore, a number of different electronic locks may also be substituted for the AUDITCON™ locks including any of the electronic locks mentioned above, which are presently available in the industry, and any other similar locks. If necessary, minor modifications to accommodate attachment of the lock actuating assembly and the lock case assembly for these alternate electronic locks may be made without departing from the scope of the present invention.

In preferred embodiments, the lock actuating assembly 2 is both mechanically and electronically interconnected with the lock case assembly. The lock actuating assembly 4 includes a code receiving mechanism 14 for entering access codes and an actuating member 16 operatively connected with the lock case assembly 6. The code receiving mechanism is electronically connected with the lock case assembly 6 such that the lock case assembly 6 can function, in response to an electronic signal from the lock actuating assembly 4 resulting from entering a predetermined access code into the code receiving mechanism 14, in a manner permitting the position of the bolt 22 to be changed from the first position to the second position by separately mechanically actuating the change of position of the bolt 22 from the first position to the second position by using physical force to change the position of the actuation member 16.

There are other two component locks systems that operate somewhat differently from the lock of the preferred embodiment. In an alternate embodiment (not shown), the alternate lock includes a bolt is spring biased such that the bolt is biased toward the first position, the lock actuating assembly is electronically interconnected with the lock case assembly and the lock actuating assembly includes a code receiving mechanism for entering access codes, wherein the code receiving mechanism is electronically connected with the lock case assembly such that the lock case assembly can function, in response to an electronic signal from the lock actuating assembly resulting from entering a predetermined access code into the code receiving mechanism, in a manner permitting the bolt to be depressed from the first position such that it can be depressed sufficiently to be in the second position.

In a further alternate embodiment (not shown), the alternate lock includes a lock actuating assembly which is electronically interconnected with the lock case assembly, the lock actuating assembly includes a code receiving mechanism for entering access codes and the code receiving mechanism is electronically connected with the lock case assembly such that the lock case assembly can function, in response to an electronic signal from the lock actuating assembly resulting from entering a predetermined access code into the code receiving mechanism, to change the position of the bolt from the first position to the second position by separately mechanically actuating the change of position of the bolt.

It is to be understood that, even though numerous characteristics and advantages of various embodiments of the present invention have been set forth in the foregoing description, together with details of the structure and function of various embodiments of the invention, this disclosure is illustrative only, and changes may be made in detail, especially in matters of shape, size and arrangement of parts, within the broad principles of the present invention, to the full extent indicated by the broad general meaning of the terms in which the appended claims are expressed.

What is claimed is:

1. A preassembled lock assembly for attachment to an enclosure door of an enclosure, the enclosure door having a lock assembly receiving opening capable of receiving the lock assembly, the enclosure door having a plurality of lock assembly receiving opening edges that interconnect with each other to fully surround the lock assembly receiving opening; the preassembled lock assembly comprising:

a lock case assembly that can secure the enclosure door in a closed position when secured thereto;

a lock actuating assembly interconnected with the lock case assembly such that the lock actuating assembly can actuate the lock case assembly so that the lock case assembly secures the enclosure door in a closed position when secured thereto; and a mounting plate having an interior side and an exterior side; the lock actuating assembly being secured to the exterior side and the lock case assembly being secured to the interior side before the preassembled lock assembly is attached to the enclosure door; wherein the preassembled lock assembly can be secured within the lock assembly receiving opening by securing at least one interior mounting plate securing bracket to the interior side of the mounting plate, when the preassembled lock assembly is inserted into the lock assembly receiving opening, to effectively grip at least one of the plurality of lock assembly receiving opening edges proximate the lock receiving opening, so that the preassembled lock assembly is effectively secured to the enclosure door.

2. The lock assembly of claim 1, wherein the lock actuating assembly is both mechanically and electronically interconnected with the lock case assembly, wherein the lock actuating assembly includes a code receiving mechanism for entering access codes and an actuating member operatively connected with the lock case assembly, the code receiving mechanism being electronically connected with the lock case assembly such that the lock case assembly can function, in response to an electronic signal from the lock actuating assembly resulting from entering a predetermined access code into the code receiving mechanism, in a manner permitting the enclosure door to be open and unsecured.

3. The lock assembly of claim 1, wherein the mounting plate has a plurality of threaded studs for receiving securing nuts; the threaded studs protruding outwardly from the interior side of the mounting plate for securing the enclosure door to the inside of the mounting plate.

4. The lock assembly of claim 1, wherein the mounting plate includes a plurality of standoffs secured to the interior side of the mounting plate.

5. The lock assembly of claim 4, wherein the lock case assembly is secured to the interior side of the mounting plate with a plurality of screws secured to the plurality of standoffs.

6. The lock assembly of claim 1, wherein the mounting plate has a plurality of drilled and tapped holes.

7. The lock assembly of claim 6, wherein the lock actuating assembly is secured to the exterior side of the mounting plate by a plurality of screws secured within the plurality of drilled and tapped holes.

8. An enclosure door for use to secure an enclosed space, the enclosure door comprising:

a lock assembly receiving opening, the enclosure door having a plurality of lock assembly receiving opening edges that interconnect with each other to fully surround the lock assembly receiving opening;

a preassembled lock assembly including a lock case assembly that can secure the enclosure door in a closed position when secured thereto; a lock actuating assembly interconnected with the lock case assembly such that the lock actuating assembly can actuate the lock case assembly so that the lock case assembly secures the enclosure door in a closed position when secured thereto; and a mounting plate having an interior side and an exterior side; the lock actuating assembly being secured to the exterior side and the lock case assembly being secured to the interior side such that the lock assembly is a preassembled independent unit that can be separated from the enclosure door without being disassembled; wherein the preassembled lock assembly is secured within the lock assembly receiving opening by at least one interior mounting plate securing bracket secured to the interior side of the mounting plate when the preassembled lock assembly is inserted into the lock assembly receiving opening to effectively grip at least one of the plurality of lock assembly receiving opening edges proximate the lock receiving opening, so that the preassembled lock assembly is effectively secured to the enclosure door.

9. The enclosure door of claim 8, wherein the lock actuating assembly is both mechanically and electronically interconnected with the lock case assembly, wherein the lock actuating assembly includes a code receiving mechanism for entering access codes and an actuating member operatively connected with the lock case assembly, the code receiving mechanism being electronically connected with the lock case assembly such that the lock case assembly can function, in response to an electronic signal from the lock actuating assembly resulting from entering a predetermined access code into the code receiving mechanism, in a manner permitting the enclosure door to be open and unsecured.

10. The enclosure door of claim 8, wherein the mounting plate has a plurality of threaded studs for receiving securing nuts; the threaded studs protruding outwardly from the interior side of the mounting plate for securing the enclosure door to the inside of the mounting plate.

11. The enclosure door of claim 8, wherein the mounting plate includes a plurality of standoffs secured to the interior side of the mounting plate.

12. The enclosure door of claim 11, wherein the lock case assembly is secured to the interior side of the mounting plate with a plurality of screws secured to the plurality of standoffs.

13. The enclosure door of claim 8, wherein the mounting plate has a plurality of drilled and tapped holes.

14. The enclosure door of claim 13, wherein the lock actuating assembly is secured to the exterior side of the mounting plate by a plurality of screws secured within the plurality of drilled and tapped holes.

15. A method of securing a preassembled electronic lock assembly to an enclosure door; the method comprising:

providing a lock assembly receiving opening in the enclosure door, the enclosure door having a plurality of lock assembly receiving opening edges that interconnect with each other to fully surround the lock assembly receiving opening;

inserting a preassembled electronic lock assembly into and at least partially through the lock assembly receiving opening; the preassembled electronic lock assembly including a lock case assembly that can secure the enclosure door in a closed position when secured thereto; a lock actuating assembly interconnected with the lock case assembly such that the lock actuating assembly can actuate the lock case assembly so that the lock case assembly secured the enclosure door in a closed position when secured thereto; and a mounting plate having an interior side and an exterior side; the lock actuating assembly being secured to the exterior side and the lock case assembly being secured to the interior side; wherein the lock assembly can be secured within the lock assembly receiving opening by at least one interior mounting plate securing bracket secured to the interior side of the mounting plate when the preassembled electronic lock assembly is so inserted, to effectively grip at least one of the plurality of lock assembly receiving opening edges proximate the lock receiving opening, so that the lock assembly is effectively secured to the enclosure door; and wherein the lock case assembly is secured to the interior side of the mounting plate;

securing the preassembled electronic lock assembly to the enclosure door by securing at least one interior mounting plate securing bracket to the interior side of the mounting plate and effectively gripping at least one of the plurality of lock assembly receiving opening edges proximate the lock assembly receiving opening so that the lock assembly is effectively secured to the enclosure door.

16. The method of claim 15 wherein the mounting plate has a plurality of threaded studs for receiving securing nuts; the threaded studs protruding outwardly from the interior side of the mounting plate for securing the enclosure door to the inside of the mounting plate; wherein the step of securing includes securing at least one interior mounting plate securing bracket to at least one of the plurality of threaded studs with a securing nut.

17. The method of claim 16 wherein the mounting plate includes a plurality of standoffs secured to the interior side of the mounting plate; and wherein the lock case assembly is secured to the interior side of the mounting plate with a plurality of screws secured to the plurality of standoffs.

* * * * *